US011008728B2

(12) United States Patent
Turner

(10) Patent No.: US 11,008,728 B2
(45) Date of Patent: May 18, 2021

(54) MANHOLE DEVICE

(71) Applicant: Caswick Limited, Doncaster (GB)

(72) Inventor: Alan James Turner, Scunthorpe (GB)

(73) Assignee: Caswick Limited, Doncaster (GB)

( * ) Notice: Subject to any disclaimer, the term of this patent is extended or adjusted under 35 U.S.C. 154(b) by 0 days.

(21) Appl. No.: 16/422,067

(22) Filed: May 24, 2019

(65) Prior Publication Data

US 2019/0360167 A1 Nov. 28, 2019

(30) Foreign Application Priority Data

May 26, 2018 (GB) ..... 1808701
May 26, 2018 (GB) ..... 1808703

(51) Int. Cl.
*E02D 29/14* (2006.01)

(52) U.S. Cl.
CPC ..... *E02D 29/14* (2013.01); *E02D 29/1463* (2013.01); *E02D 2250/00* (2013.01)

(58) Field of Classification Search
CPC ..... E02D 29/127; E02D 29/14
USPC ..... 182/128; 404/25, 26
See application file for complete search history.

(56) References Cited

U.S. PATENT DOCUMENTS 156,411 A * 11/1874 Dale ..... E02D 29/14 404/25
2,354,857 A * 8/1944 Gits ..... G09F 7/165 40/616
2,552,917 A * 5/1951 Becker ..... B62D 25/24 220/787
3,250,190 A * 5/1966 Taylor ..... E02D 29/14 404/25
3,262,599 A * 7/1966 Muller ..... E02D 29/14 220/787
3,426,659 A * 2/1969 Preston ..... E02D 17/10 404/25

(Continued)

FOREIGN PATENT DOCUMENTS

AU 2013100778 A4 7/2013
CA 2432620 A1 12/2004

(Continued)

OTHER PUBLICATIONS

Corresponding Great Britain Combined Search and Examination Report, Great Britain Application No. GB 1808703.1, dated Nov. 9, 2018.

(Continued)

*Primary Examiner* — Thomas B Will
*Assistant Examiner* — Katherine J Chu
(74) *Attorney, Agent, or Firm* — Cooper Legal Group, LLC

(57) ABSTRACT

A manhole device and corresponding system including a manhole is described. The manhole device comprises a main body having an upper portion, a lower portion and a securing means. The securing means is engageable with the manhole such that when secured to the manhole, the upper portion protrudes above a surface level and the lower portion is retained below the surface level in the manhole. The main body provides means for alignment for construction around the manhole while providing a barrier to prevent access to vehicles, people and debris during the construction process. A method of construction is also provided.

15 Claims, 12 Drawing Sheets

(56) References Cited

U.S. PATENT DOCUMENTS 4,075,796 A * 2/1978 Cuozzo ..... E02D 29/1409 404/26
4,143,432 A * 3/1979 Deken ..... A47K 1/14 4/295
4,302,125 A * 11/1981 Cullen, Jr. ..... E01F 9/553 404/15
4,957,268 A * 9/1990 Picollo ..... E03F 5/046 249/10
5,046,886 A * 9/1991 Muir ..... E01F 13/02 404/25
5,052,851 A * 10/1991 Frishauf ..... E02D 29/124 404/25
5,224,514 A * 7/1993 Taylor ..... F16L 55/11 138/89
5,499,737 A * 3/1996 Kraus ..... F16B 21/086 138/89
5,617,679 A * 4/1997 Meyers ..... E02D 29/12 220/4.26
D402,355 S * 12/1998 Bahar ..... D23/261
5,852,901 A * 12/1998 Meyers ..... E02D 29/12 52/20
5,941,025 A * 8/1999 Chang ..... E02D 29/1409 404/26
5,944,442 A * 8/1999 Roush ..... E02D 29/1409 404/26
5,979,117 A * 11/1999 Fuller ..... E02D 29/14 404/25
6,311,433 B1 * 11/2001 Zdroik ..... E02D 29/1409 404/26
6,477,972 B2 * 11/2002 Perkins ..... E02D 29/12 114/201 R
6,484,451 B1 * 11/2002 Gavin ..... E02D 29/12 220/4.03
6,584,734 B2 * 7/2003 Mihalicz ..... E01C 23/06 404/25
6,682,257 B1 * 1/2004 Zappe ..... E02D 29/14 404/25
6,830,127 B2 * 12/2004 Johnson ..... E02D 29/12 182/113
7,153,057 B1 * 12/2006 Lucas ..... E02D 29/14 404/25
D570,966 S * 6/2008 Gilligan ..... D23/260
7,574,831 B2 * 8/2009 Meyers ..... E02D 29/12 404/25
7,802,402 B2 * 9/2010 Skaggs ..... E02D 29/127 52/107
7,931,122 B2 * 4/2011 Grandy ..... E02D 29/12 182/128
D638,103 S * 5/2011 Roll ..... F16L 55/1141 D23/260
8,382,392 B2 * 2/2013 Liao ..... E02D 29/1409 404/26
9,233,652 B2 * 1/2016 Jatzke ..... B62D 25/24
9,605,403 B1 * 3/2017 Putnam ..... E02D 29/1436
9,637,885 B2 * 5/2017 Lokkinen ..... E01F 13/02
9,650,803 B1 * 5/2017 Bartels ..... E02D 27/42
9,982,411 B2 * 5/2018 Haskins ..... E02D 29/127
10,640,996 B2 * 5/2020 Hartman ..... E04G 21/32
10,934,667 B2 * 3/2021 Kirk ..... E02F 5/20
2003/0235467 A1 * 12/2003 Gamson ..... E02D 29/1409 404/26
2004/0084099 A1 * 5/2004 Miura ..... F16L 55/1141 138/89
2006/0000157 A1 * 1/2006 Karow ..... E02D 29/14 52/103
2006/0278653 A1 * 12/2006 Zeyfang ..... F16L 57/005 220/801
2008/0075532 A1 * 3/2008 Boyd ..... E02D 17/10 404/25
2008/0168719 A1 * 7/2008 Borunda ..... E04G 21/3204 52/20
2012/0297691 A1 11/2012 Gaspar
2014/0137508 A1 5/2014 Bussio
2014/0291341 A1 * 10/2014 Guarneros ..... F16J 13/14 220/789
2015/0247312 A1 * 9/2015 Brodey ..... E03F 5/0407 404/26
2020/0270837 A1 * 8/2020 Vandersyde ..... E02D 29/14

FOREIGN PATENT DOCUMENTS

CN 105756093 A 7/2016
CN 106638696 A 5/2017
EP 1243705 A1 9/2002
EP 2616595 A1 7/2013
FR 2639383 A1 5/1990
FR 2792662 A1 10/2000
GB 2249119 B 4/1992
GB 2386632 B 10/2005
GB 2468847 A 9/2010
GB 2489797 A 10/2012
JP 2013221358 A 10/2013
WO 2012034155 A1 3/2012

OTHER PUBLICATIONS

Corresponding Great Britain Combined Search and Examination Report, Great Britain Application No. GB 1808701.5, dated Nov. 2, 2018.

* cited by examiner

MANHOLE DEVICE

CROSS REFERENCE TO RELATED APPLICATIONS

This application claims priority from United Kingdom Patent Application number GB 18 08 703.1, filed on 26 May 2018 and United Kingdom Patent Application number GB 18 08 701.5, filed on 26 May 2018. The whole content of GB 18 08 703.1 and GB 18 08 701.5 is incorporated herein by reference.

BACKGROUND OF THE INVENTION

The present invention relates to a manhole device, a manhole system comprising a manhole device and a method of constructing a manhole.

Manholes are well known in the art as providing an opening from a surface level into underground vaults which comprise sewers, pipelines or other utilities or structures. Manholes are referred to throughout this specification as including the opening of the hole which provides access, and a shaft which leads down to the underground vault. Manholes are also alternatively known as inspection chambers, utility holes, cable chambers, maintenance holes, access chambers or sewer holes.

During construction works to build new roads or surfaces for example, manholes are often partially completed while the last stages of road construction are finalized. At this stage of construction, the manhole opening presents an open hole into which construction vehicles or operatives can accidentally fall into. Aside from this health and safety issue, debris is also able to fall through the hole or the partially complete manhole itself can be damaged from impact from vehicles.

In order to prevent this problem, devices have been proposed to cover the exposed manhole in use. However, such prior art devices are generally placed on top of the hole and can easily be knocked out of position thereby allowing the problem to reoccur.

A further problem exists during the construction of manholes in that these devices also need to be removed when final construction of the manhole is completed.

BRIEF SUMMARY OF THE INVENTION

According to an aspect of the present invention, there is provided a manhole device, comprising: a main body comprising an upper portion, a lower portion and a securing means; wherein said securing means is engageable with a manhole to secure said main body in the manhole, such that, when secured to the manhole, said upper portion protrudes above a surface level and said lower portion is retained below the surface level in the manhole; and said main body is configured to provide alignment means to enable construction around the manhole, and said main body further comprises an outer wall and a top surface which provide a barrier so as to prevent access to the manhole during construction.

According to a second aspect of the present invention, there is provided a manhole system comprising a manhole and a manhole device, said manhole device comprising: a main body comprising an upper portion and a lower portion, said main body being positioned in said manhole; wherein said upper portion protrudes above a surface level, and said lower portion includes a securing means configured to retain said lower portion below said surface level and in said manhole; and further wherein said main body provides alignment means to enable construction around said manhole, and said main body further comprises an outer wall and a top surface which provide a barrier so as to prevent access to said manhole during construction.

According to a third aspect of the present invention, there is provided A method of constructing a manhole, comprising the steps of: obtaining a manhole device having a main body comprising an upper portion, a lower portion and a securing means; positioning said manhole device in the manhole such that said upper portion protrudes above a surface level and said lower portion is retained below said surface level in the manhole; engaging said securing means with said manhole to secure said manhole device in position; providing an alignment means to enable construction around said manhole by means of said main body; and preventing access to said manhole during construction by providing a barrier by means of an outer wall and a top surface of said main body.

BRIEF DESCRIPTION OF THE SEVERAL VIEWS OF THE DRAWINGS

The invention will now be described by way of example, with reference to the accompanying drawings, of which.

DETAILED DESCRIPTION OF THE INVENTION

FIG. 1

Figure 1:
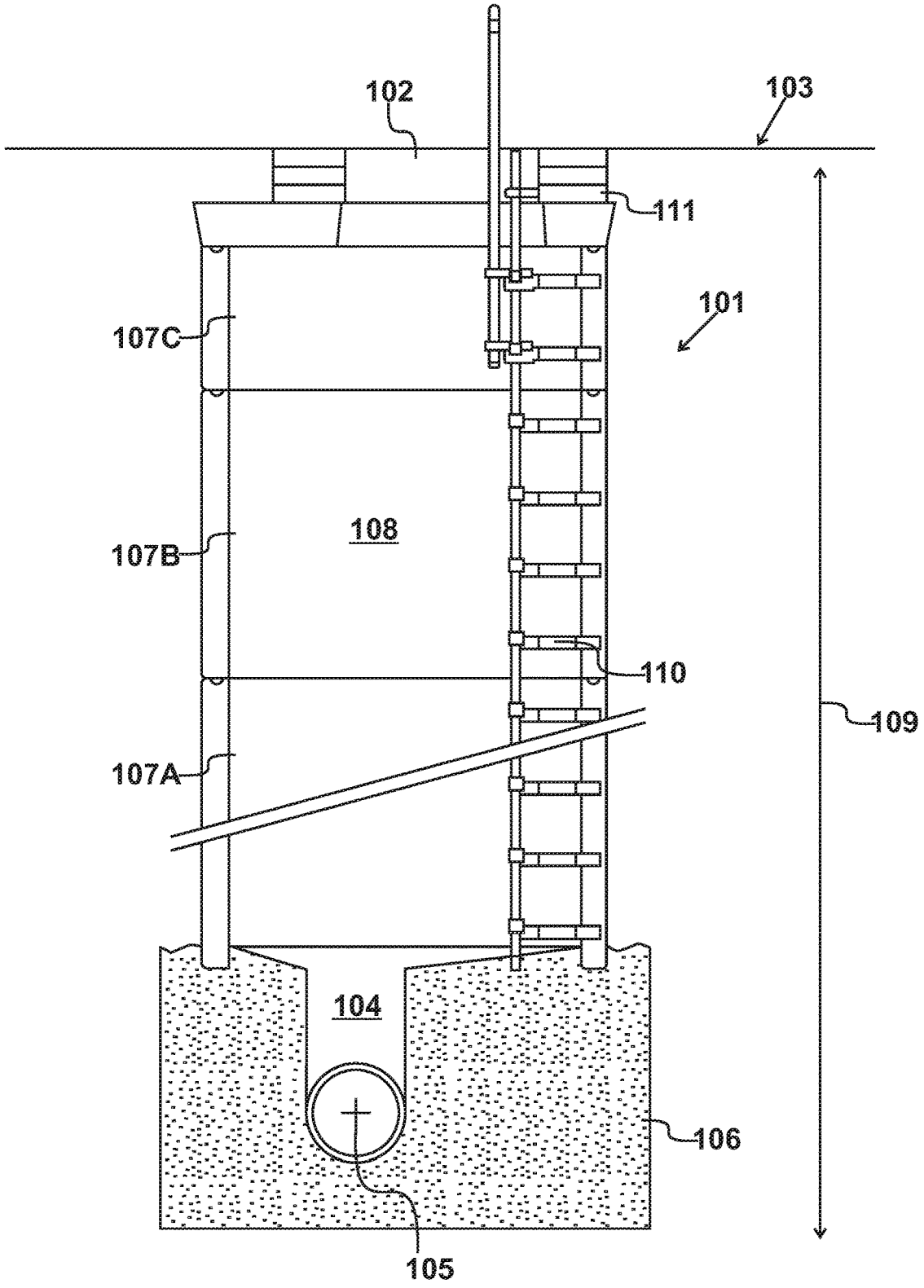
Fig. 1 (Prior Art)
FIG. 1 shows a typical manhole arrangement.

A typical manhole arrangement in accordance with known structures is shown with respect to FIG. 1. Manhole 101 provides an opening 102 from surface level 103 into an underground vault 104. In this illustrated example, underground vault 104 comprises a pipeline 105 which is fitted inside a concrete base 106 underneath surface level 103. It is appreciated that manhole arrangements of this type may include alternatives to pipelines, for example other utilities and structures including cabling or wiring.

Manhole 101 typically comprises a plurality of manhole rings 107 which are stacked to a desired height such that surface level 103 is defined in line with any landscaping requirements. Manhole rings typically comprise large hollow cylindrical concrete structures which are stackable to create the manhole shaft 108. While the example illustrates three manhole rings, any number of manhole rings may be used to achieve a suitable surface height 109.

Manhole 101 further includes an access ladder 110 such that authorized operatives are permitted to access underground vault 104 through opening 102. In order to define opening 102, a plurality of seating rings, such as seating ring 111, are positioned around opening 102. Each seating ring comprises a concrete plate having a central hole which is dimensioned in line with the requirements for opening 102. In alternative embodiments, instead of seating rings, opening 102 is defined by an alternative solution, such as a plurality of bricks and concrete or other solid structure. Once, constructed, opening 102 is covered by a conventional manhole cover, however, this is not the case during construction works.

As indicated previously, during construction works, such as in the construction of a road surface, opening 102 is left open such that debris, vehicles or people could potentially fall in. Not only does this present a safety hazard, but it is also difficult to remove any debris once the manhole system has been completed.

FIG. 2

Figure 2:
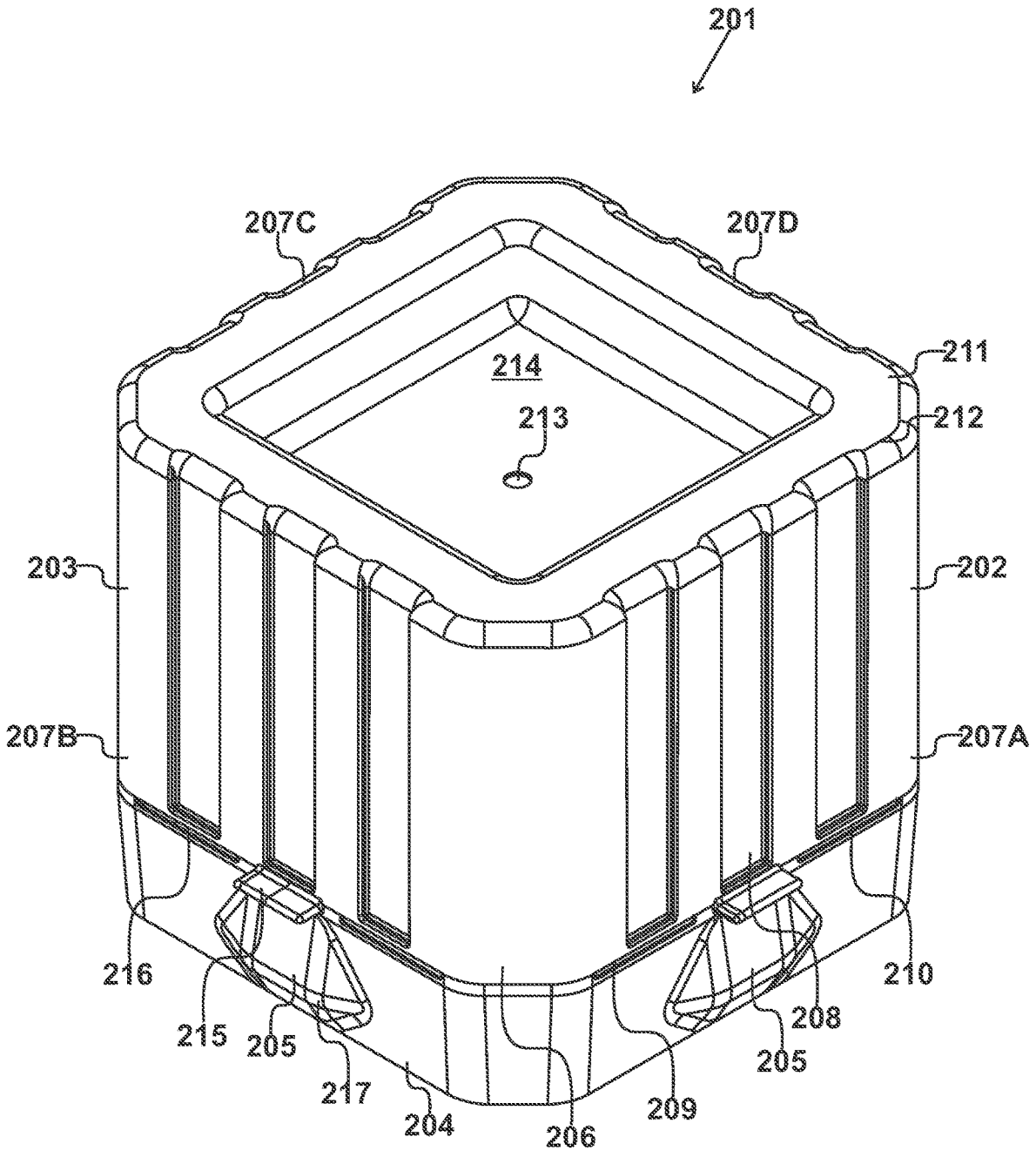
FIG. 2 shows a manhole device in accordance with the present invention.

A manhole device 201 in accordance with the present invention is shown in isolation in a perspective view in FIG. 2. Manhole device 201 comprises a main body 202 having an upper portion 203 and a lower portion 204. Main body 202 further comprises a securing means 205.

Main body 202 comprises an outer wall 206, which, in this embodiment, comprises four side walls 207. In the embodiment, manhole device is substantially square or cuboid in shape; however, it is appreciated that in an alternative embodiment, as required by the manhole structure in question, the manhole device may be cylindrical in shape and comprises a single outer wall having substantially similar features.

In the embodiment, outer wall 206 comprises a ribbed outer surface which includes a plurality of ribs. Manhole device 201 may comprise a durable plastic material with a degree of flexibility therein. The plastic material may be any suitable material for the purpose, and, in an embodiment, comprises polyethylene. The plurality of ribs improves the rigidity of manhole device 201 which assists in maintaining the device's shape and structure in use.

Figure 8:
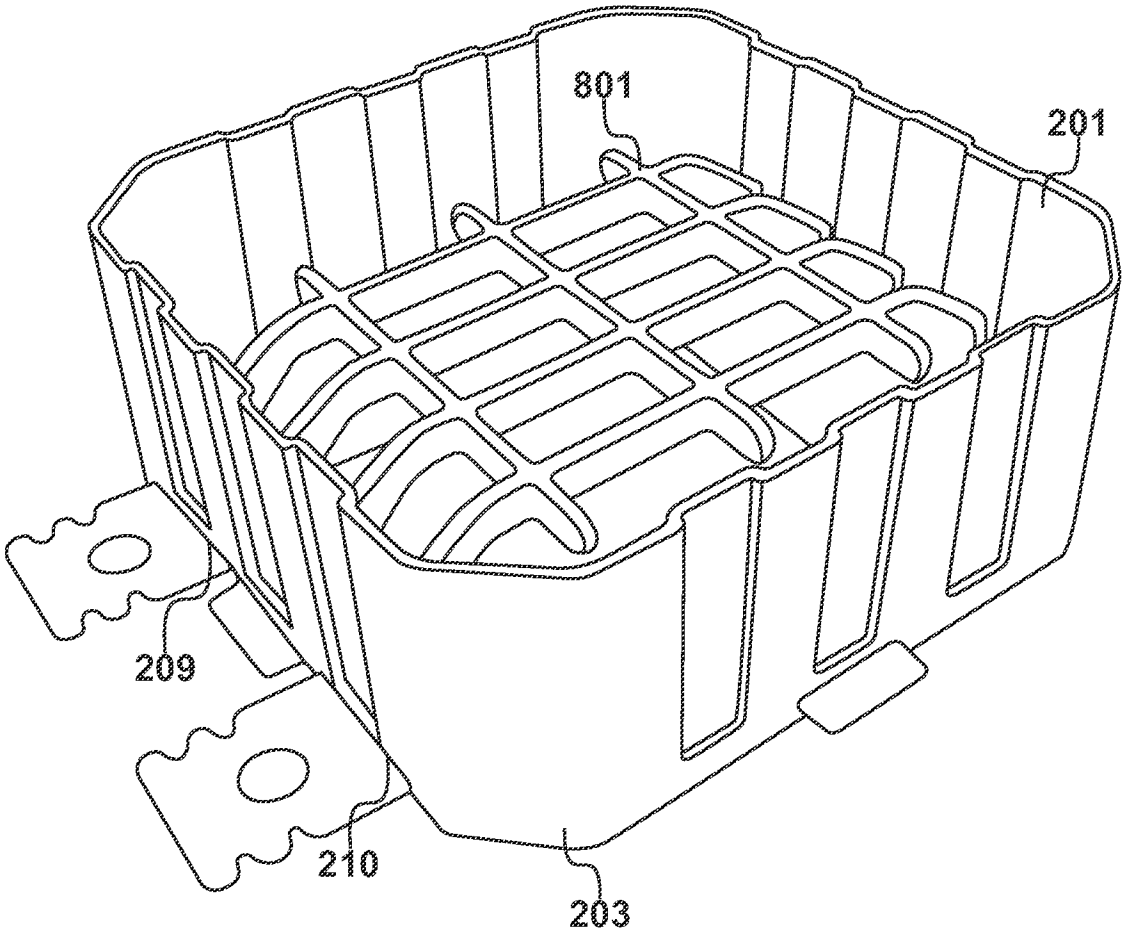
FIG. 8 shows the manhole device in diagrammatic form in use with a suitable grating device.

In the embodiment, outer wall 206 further comprises at least one slot, such as slots 209 and 210 which are configured to receive a grating device as will be described further with reference to FIG. 8. In the embodiment, each side wall 207 includes two slots, however, it is appreciated that, any number of slots may be provided so as to provide appropriate securing points for a suitable grating device.

Main body 202 further comprises a top surface 211 which extends from an edge 212 of outer wall 206. Top surface 211 comprises a ventilation hole 213 which allows for ventilation in use. Top surface 211 further comprises a cavity 214 which extends below edge 212 to define a bowl. In use, cavity 214 can be used to support weighted material or a visual indicator. The shape of cavity 214 may also be configured to channel rainwater or similar from cavity 214 and into ventilation hole 213. In an embodiment, a suitable cap is provided to block or cover ventilation hole 213 as necessary. In an alternative embodiment, a plurality of ventilation holes is present in the top surface and it is appreciated that any number of holes may be present as required.

Securing means 205 comprises a tab 215 at an interface 216 between upper portion 203 and lower portion 204. Securing means 205 further comprises a tapered wedge 217 which, in use, is configured to interfere with an inner surface of a manhole (e.g., to establish an interference fit) as will be described further with respect to FIG. 4.

In an embodiment, upper portion 203 of manhole device 201 comprises a visual indicator to improve visibility of the upper portion. In particular, this visual indicator may comprise a fluorescent color, hazard warning stripes, a reflective paint or material or similar. In one embodiment, manhole device 201 is painted in an appropriate visible or reflective color so as to provide the increased visibility.

FIG. 3

Figure 3:
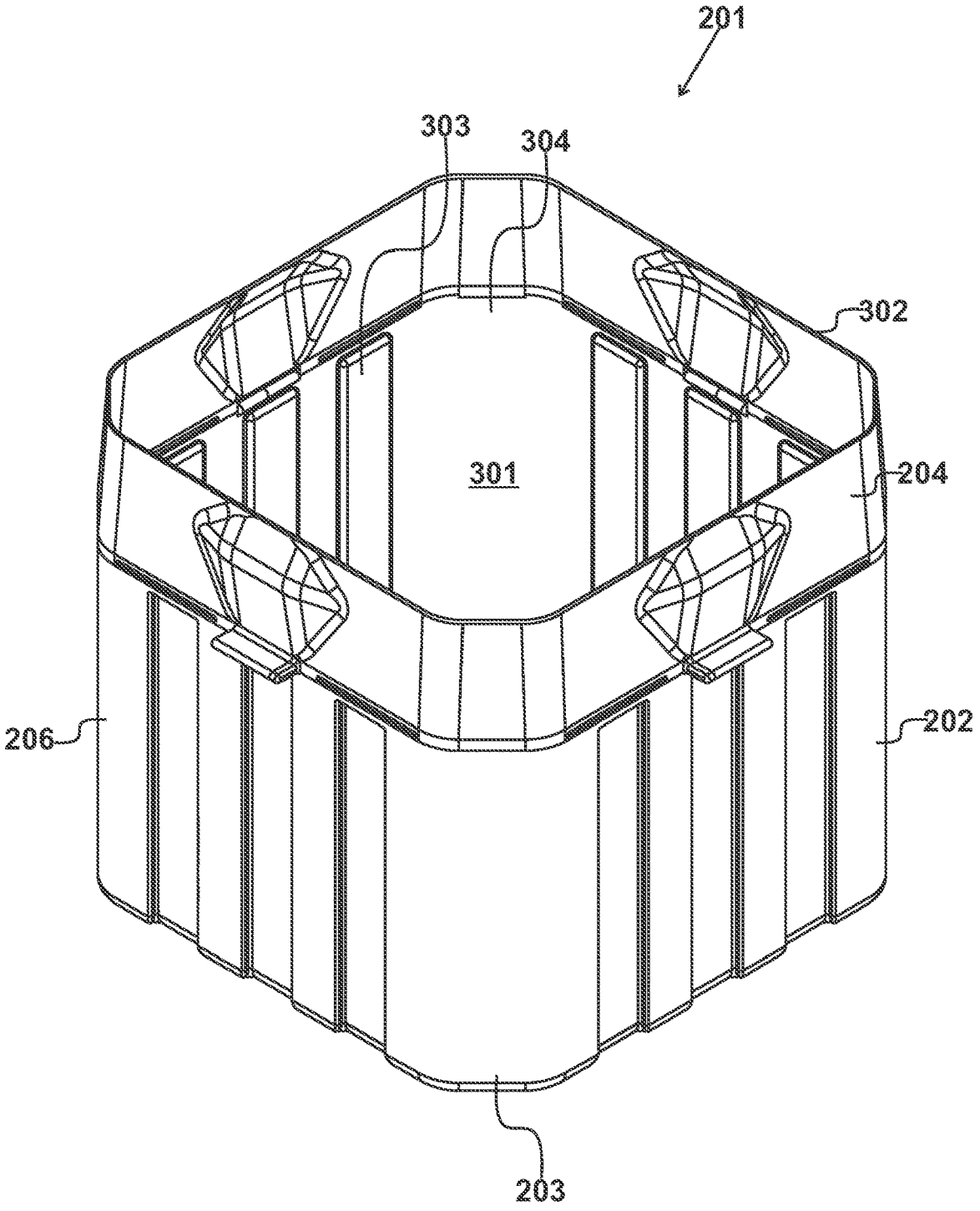
FIG. 3 shows an alternative perspective view of the manhole device of FIG. 2.

An alternative perspective view of manhole device 201 is shown in FIG. 3. In this illustrated view, manhole device 201 is shown in a reverse orientation to that of FIG. 2, such that the bottom of manhole device 201 is visible.

Manhole device 201 again shows main body 202 having upper portion 203, lower portion 204 and outer wall 206. Outer wall 206 defines an internal space 301. Thus, it can be seen in this alternative view that manhole device 201 is hollow. In this way, top surface 211 as previously described prevents access into internal space 301 when manhole device 201 is positioned in the orientation of FIG. 2.

In the orientation of FIG. 3, however, internal space 301 can be accessed via an open end 302 in lower portion 204.

In the embodiment, ribbed outer surface 208 provides a corresponding ribbed inner surface 303. Main body 202 however, further comprises a smooth internal surface 304 so as to prevent snagging of people and/or equipment in use. Thus, ribbed inner surface 303 typically includes rounded edges so as to prevent any sharp edges which could get caught on people and/or equipment.

FIG. 4

Figure 4:
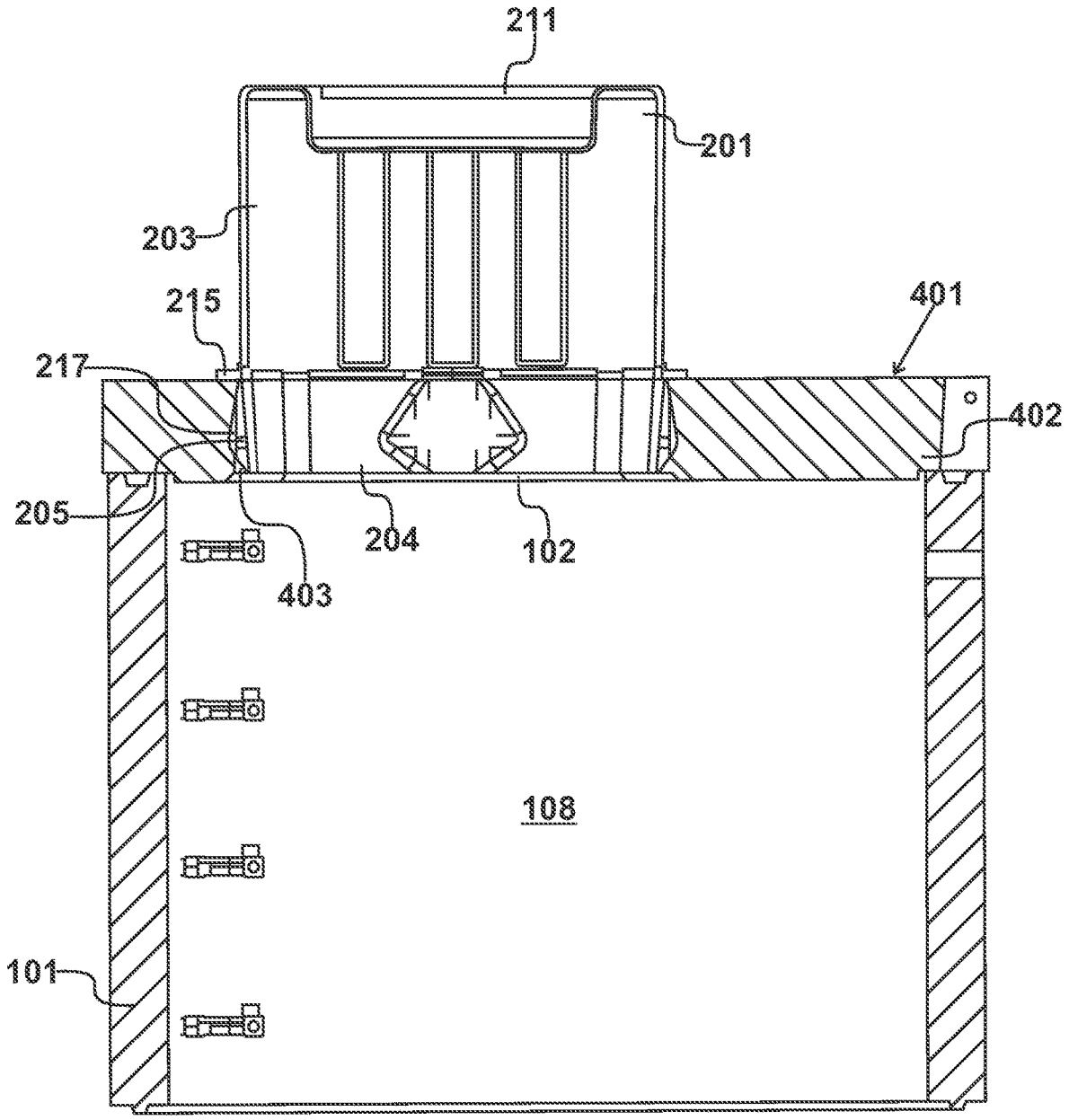
FIG. 4 shows a partial cross-sectional view of the manhole device in a manhole.

Manhole device 201 is shown in FIG. 4 positioned in manhole 101 in a partial cross-sectional view. When in situ in manhole 101, upper portion 203 protrudes above a surface level 401 defined, in this embodiment, by a cover slab 402. In contrast, lower portion 204 is retained below surface level 401 and inside opening 102 of manhole 101 by securing means 205.

As previously explained, securing means 205 comprises a tab 215 and a tapered wedge 217 and is engageable with manhole 101 such that, when secured to the manhole 101, upper portion 203 protrudes above the surface level and the lower portion is retained below the surface level.

In use, tab 215 rests upon the surface level 401 of cover slab 402 so as to retain upper portion 203 above surface level 401. Thus, tab 215 prevents manhole device 201, and in particular upper portion 203, from entering opening 102. Tapered wedge 217 additionally provides securement by interfering with an inner surface 403 of opening 102 of manhole 101. Tapered wedge 217 comprises a resiliently flexible material which is biased outwards from manhole device 201 so as to interfere and grip with inner surface 403 to hold manhole device 203 in position. Thus, should a person or vehicle knock or disturb manhole device 201, tapered wedge 217 assists in maintaining manhole device 201 within manhole 101.

Thus, in this way, the manhole device 201 does not require additional fastenings such as bolts or screws to be utilized.

In the embodiment, top surface 211 prevents access into the internal space 301 of manhole device 201 as well as preventing access into opening 102 of manhole 101 and manhole shaft 108. Thus, in this orientation, debris, vehicles or people cannot gain access into manhole shaft 108 without removal of manhole device 201.

FIG. 5

Figure 5:
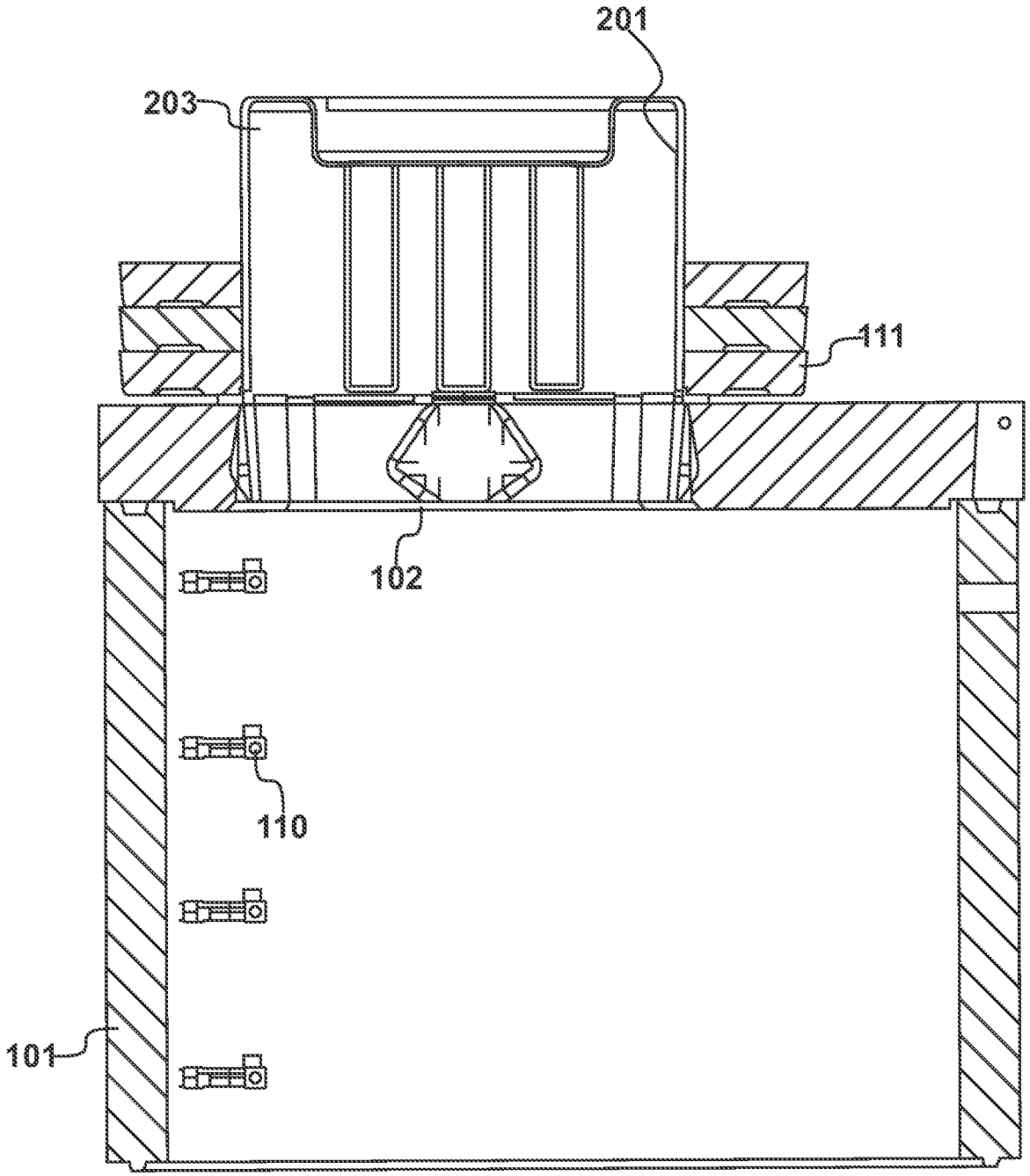
FIG. 5 shows a partial cross-sectional view of the manhole device in a manhole providing an alignment means for construction of the manhole.
Figure 6:
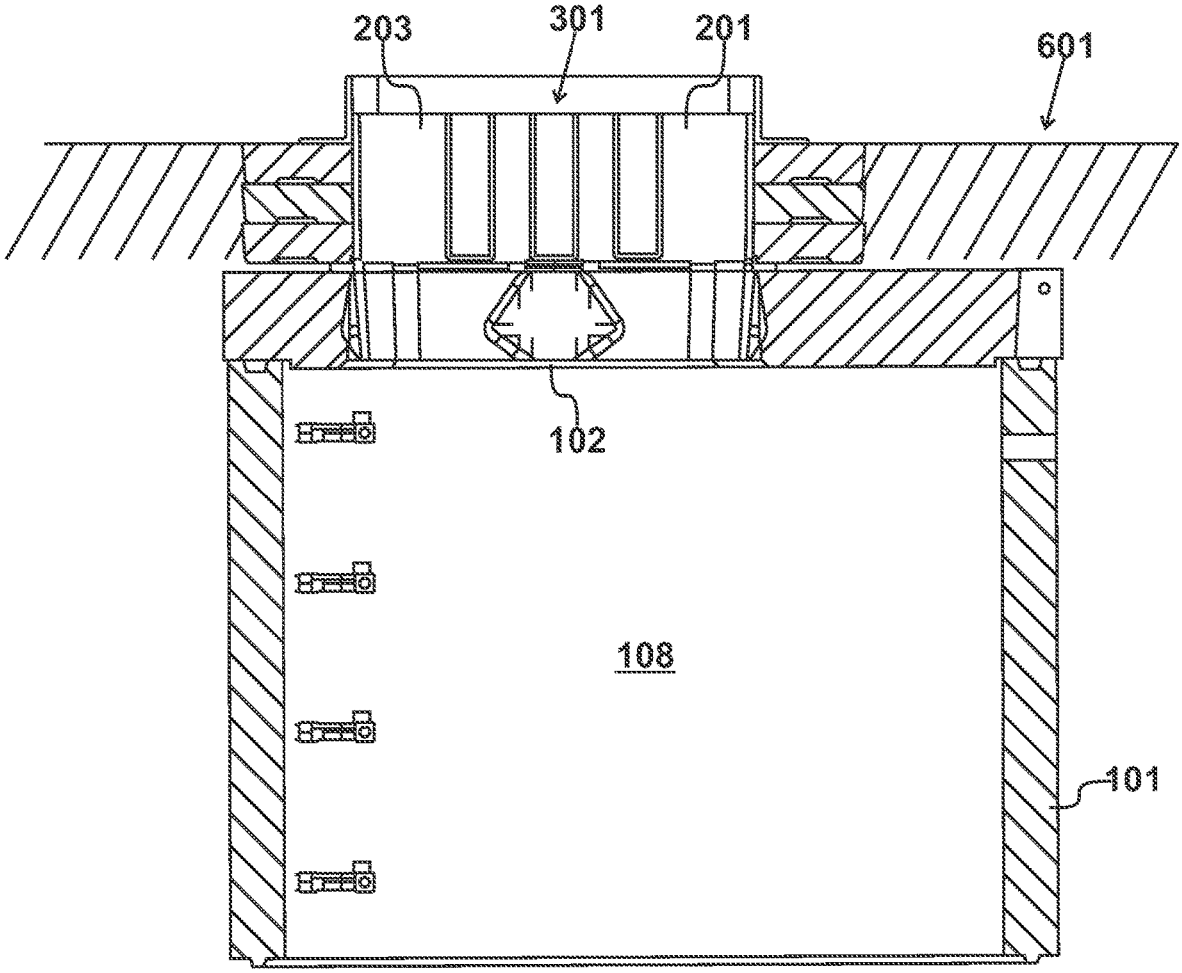
FIG. 6 shows a partial cross-sectional view of the manhole device in a manhole providing a liner following construction of the manhole.

Once positioned in the manhole opening 102, manhole device 201 protects debris, people or vehicles from accessing manhole 101. While in position, manhole device 201 further provides a guide or alignment means for construction of the manhole 101 as will be illustrated with respect to FIG. 5.

In the construction of manhole 101, a plurality of seating rings, such as seating ring 111, are conventionally positioned around opening 102 to provide extension of manhole 101 up to a surface level. Seating rings typically comprise a concrete plate with a central hole and are stacked vertically to extend the height of the hole. While seating rings are sized to provide an opening of a required diameter or dimension, alignment of the seating rings are required so as to meet industry requirements in terms of providing appropriate access into manhole 101. For example, the center hole of the seating rings is dimensioned to provide sufficient room for an operative to enter the manhole in use including the equipment they would typically carry and sufficient space to allow them to reach the access ladder 110. The Sewers for Adoption guidance in the United Kingdom requires a minimum aperture of six hundred millimeters (600 mm) for this purpose, and thus the seating rings center hole is dimensioned accordingly. Furthermore, the Sewers for Adoption guidance also requires a maximum distance of six hundred and seventy-five millimeters (675 mm) between the final surface level and the top step of ladders 110 so that the ladders can be adequately reached in use.

When in situ, main body 202 of manhole device 201 is configured to provide alignment means for construction around manhole 101 while also providing a barrier which prevents access during the construction process. Thus, manhole device 201 is dimensioned to firstly maintain the size of the opening 102 at an appropriate diameter, but also provides an alignment of seating rings 111 so that they are consistently positioned and aligned around manhole device 201 and ensuring that construction operatives maintain the legislative guidance dimensions during construction. At the same time, manhole device 201 provides a barrier to debris, vehicles and/or people into the manhole and stops any such items falling into the manhole while construction is taking place.

Furthermore, manhole device 201 is configured to be such a height to give an indication to construction operatives as to where the final surface level should reach. In this way, it can be ensured that the minimum distance to the ladders 110 can be maintained so that requirements are met. Thus, the manhole device 201 provides an indication of the maximum required height of a final surface by means of the protruding upper portion 203. In an alternative embodiment, this process may be assisted by additional markings or wording illustrated on the side of manhole device 201.

Thus, manhole device 201 not only provides an alignment means for the seating rings, but also provides a height guide in terms of final surface level. As noted previously, while the embodiment illustrates seating rings to be used for construction of the manhole 101, alternatives to seating rings may also be utilized, such as bricks and concrete. As it will be appreciated, these alternatives may be even more difficult to provide alignment for and therefore the manhole device provides suitable alignment means in this alternative embodiment.

FIG. 6

Once construction of manhole 101 has been completed, manhole device 201 is no longer required as a guide for construction or as a device for blocking access into manhole 101. However, instead of removing manhole device 201 from opening 102 of manhole 101, manhole device 201 is configured to remain in situ in opening 102 once construction has been completed.

Thus, at least part of upper portion 203 is removable from lower portion 204 so as to provide access to manhole 101 and manhole shaft 108 via internal space 301 from a ground surface 601. Thus, in this way, the remainder of manhole device 201 is retained within manhole 101 to provide a liner. As a liner, the smooth internal surface 304, as previously described with respect to FIG. 3, is able to perform its function of preventing snagging from operatives or their equipment once they are authorized to enter and exit the manhole 101.

In an embodiment, the part of the upper portion which is removed is removed by means of cutting with a suitable tool, which includes, but is not limited to hand saws or powered saws. Once this part has been removed, the manhole device 201 is retained in place by the securing means and the surrounding concrete and seating rings.

FIG. 7

Figure 7:
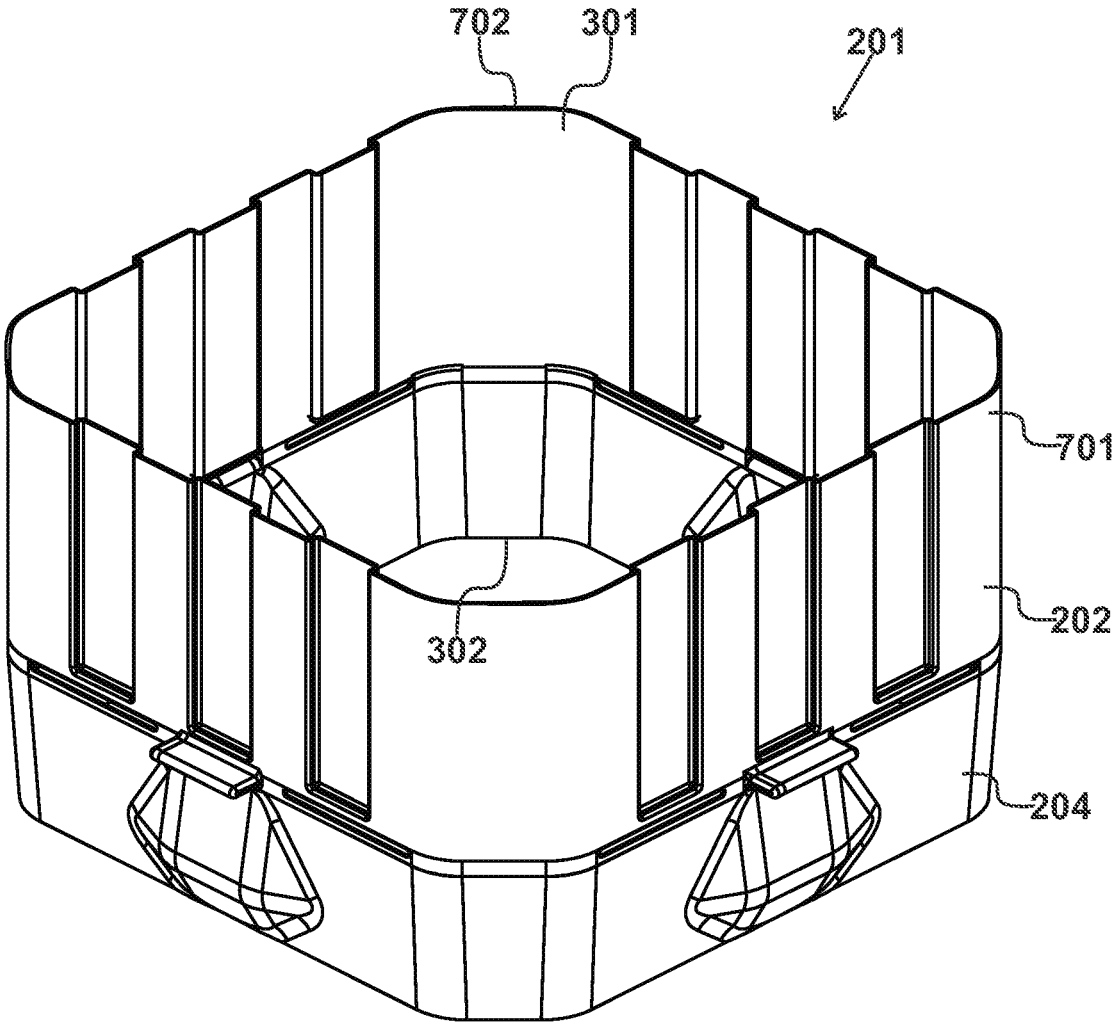
FIG. 7 shows a perspective view of the manhole device in isolation having had a part of an upper portion removed.

An additional perspective view of manhole device 201 in isolation is shown in FIG. 7. FIG. 7 shows manhole device 201 as if it had been removed from manhole 101, although in practice this would not be necessary.

It can therefore be seen that manhole device 201 comprises main body 202 which now comprises lower portion 204 and a reduced size upper portion 701. This therefore presents two open ends, open end 702 as well as previously described open end 302. Internal space 301 therefore extends between the two ends thereby providing access to manhole 101 as required.

FIG. 8

Manhole device 201 is also configured to be used with a grating device 801. FIG. 8 shows manhole device 201 in the configuration of FIG. 7, in diagrammatic form without the surrounding constructed surface and seating rings, whereby a part of upper portion 203 has been removed to enable access to manhole 101.

As previously noted, manhole device 201 comprises at least one slot such as slots 209 and 210 which are configured to receive grating device 801 in the manner illustrated. Grating device 801 can be any suitable grating device which assists in providing limited access to manhole 101. An example of a suitable grating device will now be described with respect to FIG. 9.

FIG. 9

Figure 9:
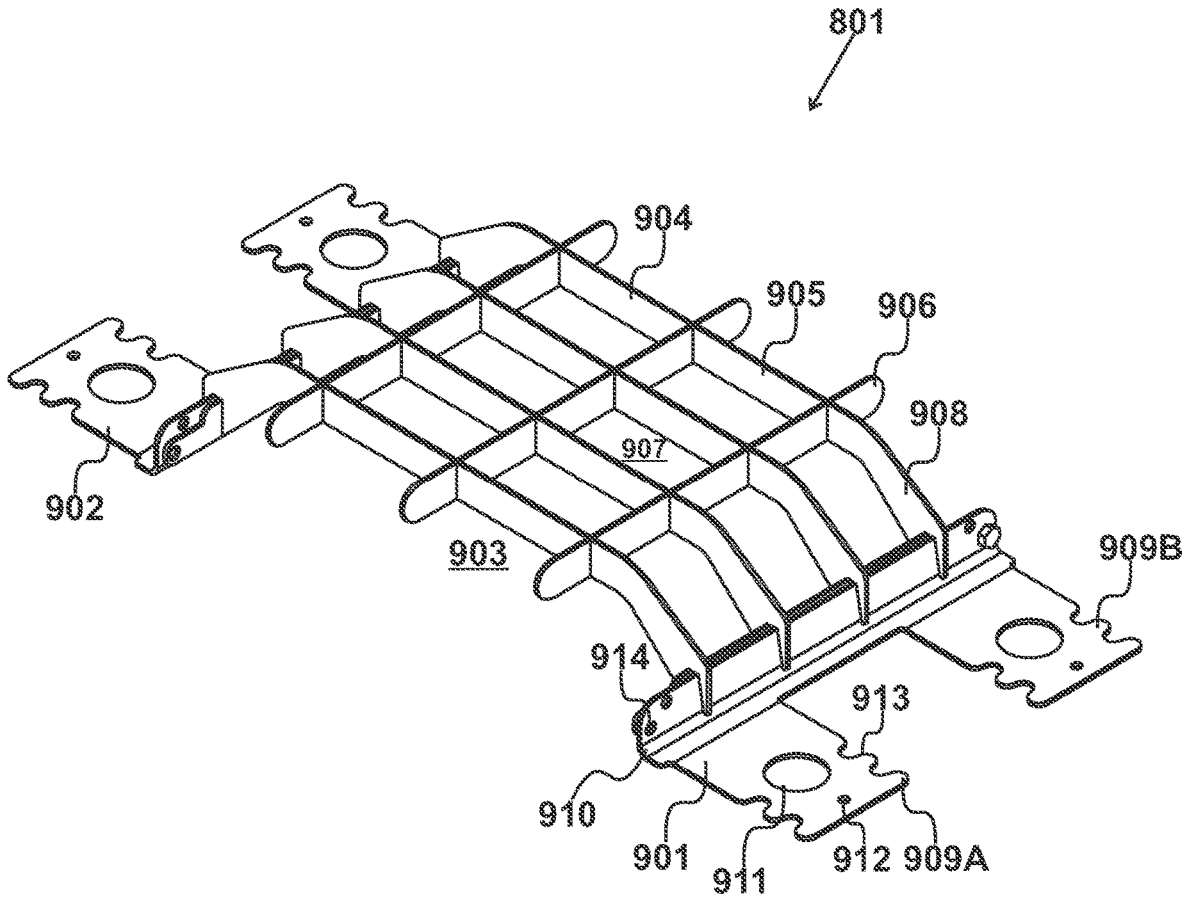
FIG. 9 shows a grating device for preventing access into a manhole in a closed configuration.

A device for preventing unauthorized access into manhole 101 is shown in FIG. 9. Grating device 801 is shown in isolation in a closed configuration. In this closed configuration, once fitted to manhole 101, access into manhole 101 would be prevented.

Grating device 801 comprises at least one support bracket, and, in this embodiment, comprises two support brackets 901 and 902. Support brackets 901 and 902 define an open space 903 therebetween which, when in an open configuration and fitted to manhole 101, permits access into the manhole via open space 903.

Grating device 801 further comprises grating 904 which extends across open space 903 so as to prevent access through open space 903 in use. Grating 904 comprises a plurality of vertical cross members arranged in a first direction, such as cross member 905, and a second plurality of horizontal cross members arranged in a second direction, such as cross member 906. Each plurality of cross members is arranged such to form a grid whereby each connecting cross member defines a grate opening, for example grate opening 907. This arrangement ensures that, for example, when a manhole is subjected to flooding, floodwater is free to flow through the grating so as to avoid undesirable pressure build up. Each grate opening is suitably sized such that a pedestrian's foot would not fall through any of the grate openings, should they come into contact with grating device 801 when fitted into the manhole.

In the embodiment, grating 904 comprises a substantially dome-shaped profile 908 whereby the vertical cross members are arched to define the dome-shaped profile. It is noted that the dome-shaped profile comprises a relatively flat top surface to the grating such that grating 904 is able to support a pedestrian without causing further injury.

Grating device 801 comprises support brackets 901 and 902, which in the embodiment are substantially similar. Referring specifically to support bracket 901, support bracket 901 comprises a support plate 909 and a support bar 910 attached thereto. In this embodiment, support bracket 901 comprises two support plates; however, it is appreciated that in alternative embodiments, any number of support plates may be present depending on requirements. Support plate 909 comprises an aperture 911 which is configured to receive a support block. Such a support block may be a concrete block which could be utilized to hold grating device 801 in position in the manhole. Support plate 909 further comprises an attachment hole 912 which is configured to receive a fastener. Support plate 909 also has a serrated edge 913 along two sides of each support plate. The serrated edge is configured to provide an increased surface area such that, when surrounded by concrete or similar, the serrated edge assists in holding grating device 801 in position.

Support bar 910 further comprises a hole 914, or a plurality of holes, which are configured to receive a locking mechanism which can be utilized to maintain device 201 in the closed configuration shown in FIG. 2. The locking mechanism may be, for example, a lockable clamp or padlock or similar, which would be put in place by the appropriate utility companies. Thus, unauthorized access could be prevented by this means once grating device 801 is in place.

Figure 10:
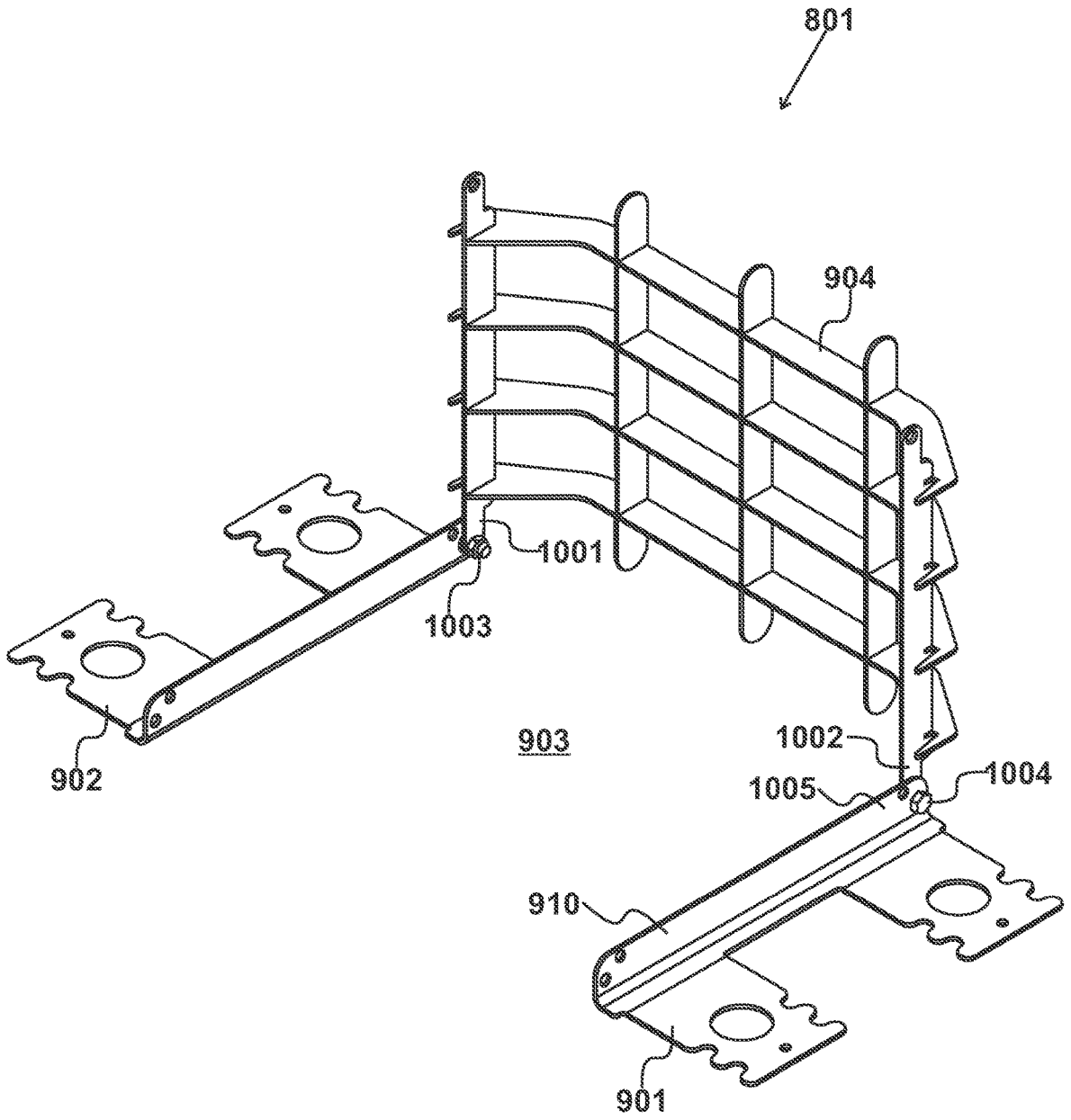
FIG. 10 shows the grating device of FIG. 9 in an open configuration.

Grating 904 is pivotably attached to support brackets 901 and 902 such that grating 904 can be moved from the closed configuration of FIG. 9 to the open configuration of FIG. 10 and vice versa.

FIG. 10

Grating device 801 is shown in isolation in the open configuration in FIG. 10. In this illustrated embodiment, grating 904 is in a fully open configuration, although it is appreciated that grating 904 may be positioned at any angle between the fully closed configuration of FIG. 9 and the fully open configuration of FIG. 10.

Grating device 801 comprises at least one linking arm, and in this embodiment, two linking arms 1001 and 1002. Each of these linking arms extends from grating 904 and is pivotably attached to the support bars of support brackets 901 and 902. Pivots 1003 and 1004 are positioned at one end of each respective support bar and comprise a bolt through each support bar, although other variations on pivots may be used. For example, pivot 1004 is positioned at end 1005 of support bar 910. These pivots allow grating 904 to be pivotable in a direction away from open space 903 such that, in use, open space can be utilized to allow access to a manhole 101.

It is appreciated that, in the embodiment, two linking arms are utilized and each provides a suitable pivot. In an alternative embodiment, a single linking arm is present which provides a single pivot. In further embodiments, more than two linking arms are present and each provides a pivot to enable grating 904 to move from the open configuration to the closed configuration as required.

Grating device 801 may be manufactured from any suitable durable material such as galvanized steel, stainless steel, plastic, other metals or glass fiber reinforced plastic (GFRP). It is appreciated that any other suitable materials may be utilized.

FIG. 11

Figure 11:
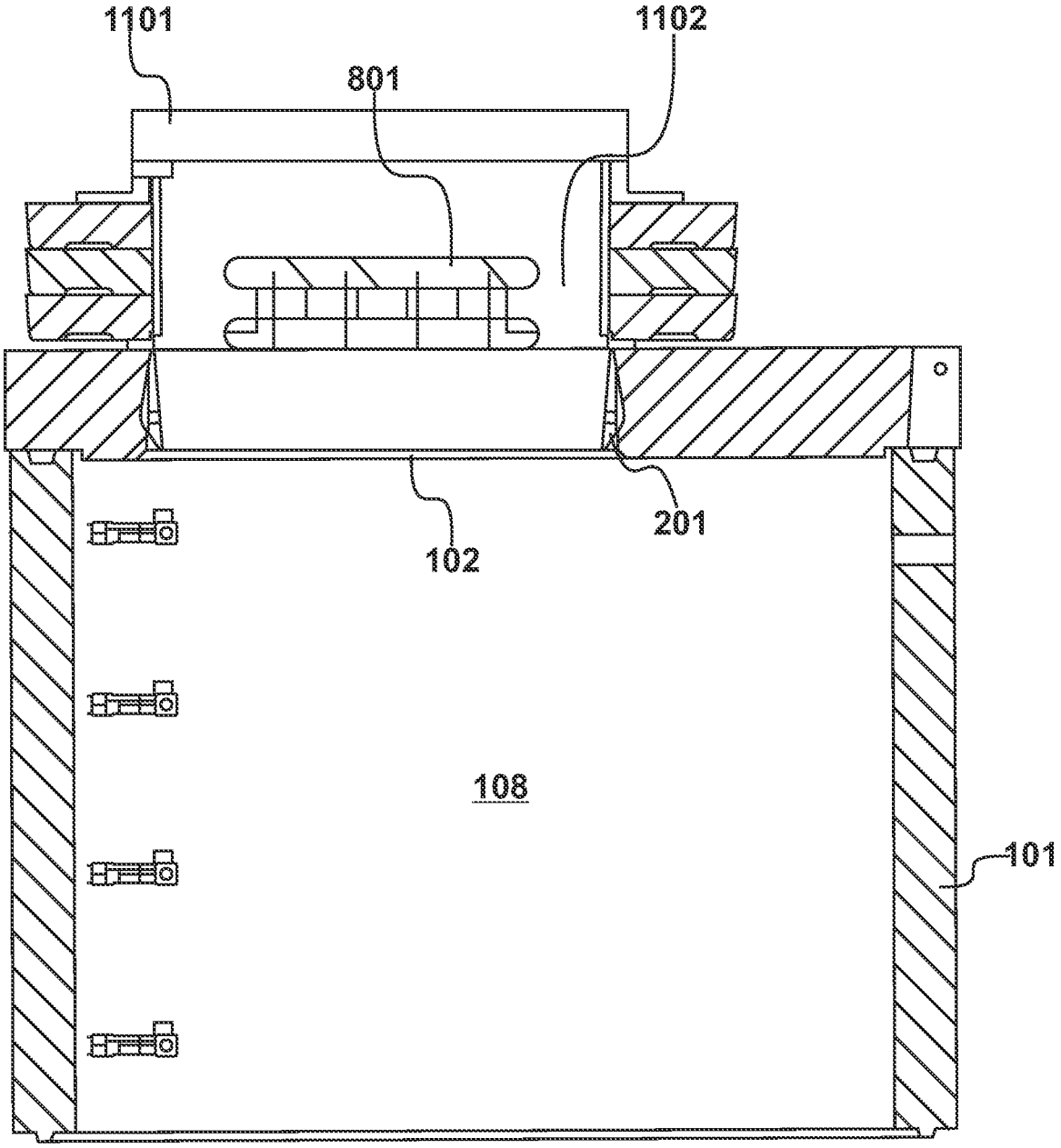
FIG. 11 shows a cross-sectional view of the grating device of FIG. 9 when fitted into manhole in a closed configuration.

A cross-sectional view of grating device 801 when fitted into manhole 101 is shown in FIG. 11. Grating device 801 is secured into position extending across opening 102. Grating device 801 is positioned between manhole shaft 108 and a manhole cover 1101 through the slots of manhole device 201.

Figure 12:
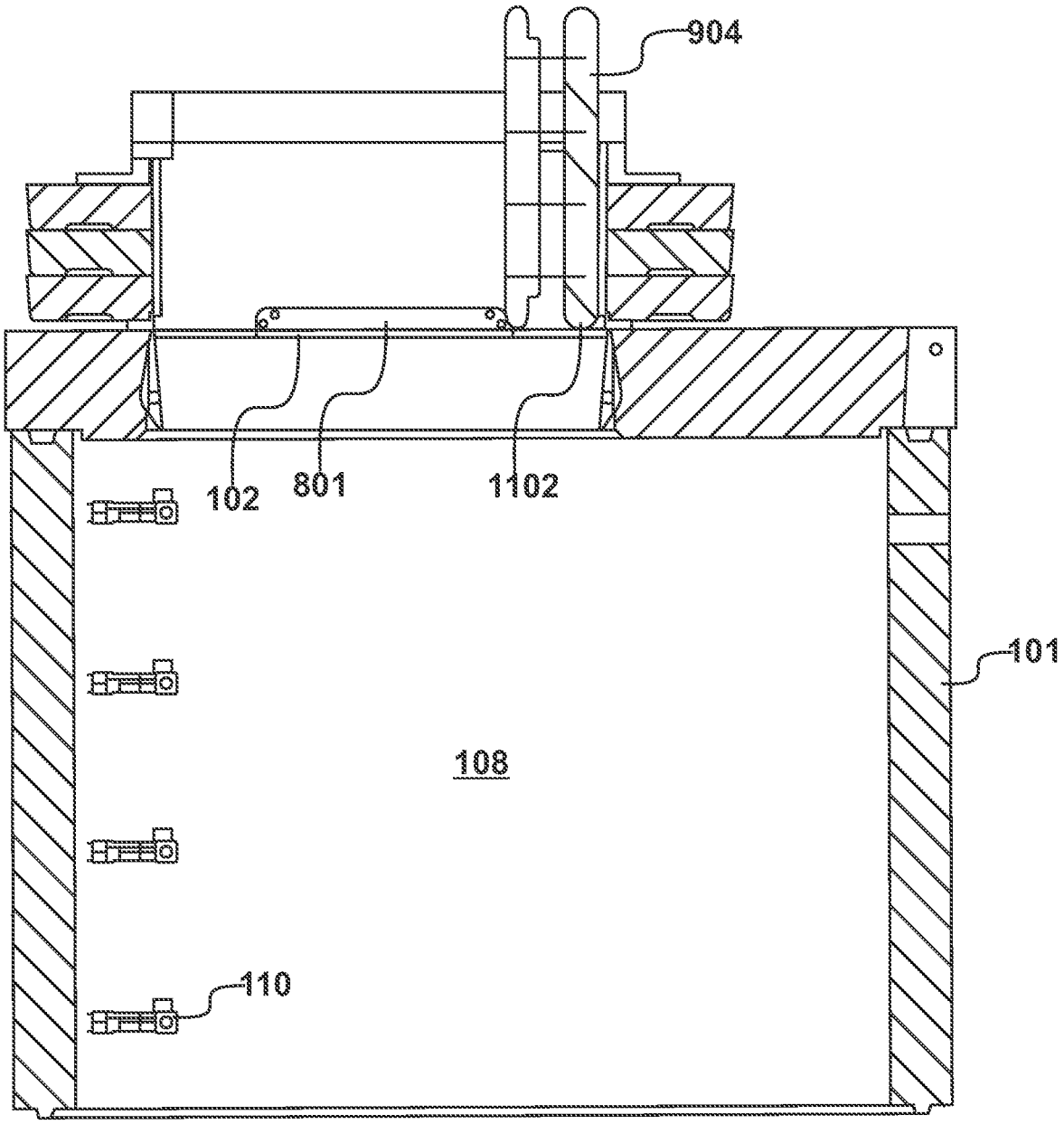
FIG. 12 shows a cross-sectional view of the grating device of FIG. 9 when fitted into manhole in an open configuration.

When secured in position, grating device 801 is able to move between the closed configuration of FIG. 11 and an open configuration shown in FIG. 12, each which correspond to FIGS. 9 and 10 respectively. In the closed configuration, grating device 801 may include a locking mechanism which maintains grating device 801 in the closed configuration to prevent unauthorized access into manhole shaft 108, even if manhole cover 1101 has been removed or dislodged.

As can be seen in FIG. 11, when in position in manhole 101, grating device 801 extends across opening 102. A cavity 1102 is present at one side of the shaft above the opening 102 and this cavity is configured to receive the dome-shaped profile 908 of grating device 801 when grating device 801 is in the open configuration.

Thus, when manhole cover 1101 is removed, grating device 801 can be pivoted by means of the pivots provided, and grating 904 can reside in cavity 1102 while grating device 801 remains in the open configuration, as will be illustrated in FIG. 12.

FIG. 12

A further cross-sectional view of grating device 801 when fitted to manhole 101 is shown in FIG. 12. Grating 904 has been pivoted away from opening 102 and open space 903 into the open configuration.

In the embodiment, grating 904 is positioned substantially vertically in orientation such that open space 903 and opening 102 are accessible such that an authorized operative or similar can enter manhole 101 and manhole shaft 108. When positioned vertically in this manner, grating 904 resides in cavity 1102. This allows an operative to enter manhole 101 from the opposing side of the manhole and reach access ladder 110 in a conventional manner.

It is observed with reference to FIGS. 11 and 12 that the construction of grating device 801 is such that grating device 801 can be fitted into a manhole with minimum restrictions for authorized operatives entering and exiting a manhole. Under industry requirements for construction of manholes in the United Kingdom, The Sewers for Adoption guidance requires a minimum opening of six hundred millimeters (600 mm) to enable operatives to enter and exit a manhole without undue restrictions. Thus, it is important that grating device 801 takes up a minimum amount of space inside a manhole so that this opening size can be maintained so that access requirements are met. In this way, use of cavity 1102 provides a compact arrangement that enables requirements to be met adequately.

The invention claimed is:

1. A manhole device, comprising:

a single-piece main body comprising an upper portion, a lower portion and a securing means;

wherein:

said securing means is engageable with a manhole to secure said single-piece main body in said manhole, such that, when secured to said manhole, said upper portion protrudes above a surface level and said lower portion is retained below said surface level in said manhole, said single-piece main body is configured to provide alignment means to maintain a diameter or dimension of an opening of said manhole, said opening providing access to an underground vault, said single-piece main body is further configured to position and align construction materials around said manhole, said single-piece main body further comprises an outer wall defining an internal space and a top surface, said top surface extending from an edge of said outer wall to cover said internal space, said top surface thereby preventing access into said internal space and providing a barrier so as to prevent access to said manhole during construction, and said single-piece main body comprises at least one slot in said outer wall; and a grating device comprising at least one support bracket for being received into said at least one slot, wherein at least part of said upper portion is removable to provide access for said grating device.

2. A manhole device according to claim 1, wherein said outer wall comprises a ribbed outer surface.

3. A manhole device according to claim 1, wherein said top surface comprises a ventilation hole to allow ventilation to said manhole when fitted.

4. A manhole device according to claim 1, wherein said top surface comprises a cavity.

5. A manhole device according to claim 1, wherein said single-piece main body further comprises an open end in said lower portion.

6. A manhole device according to claim 1, wherein said securing means comprises a tab at an interface between said upper portion and said lower portion, said tab thereby preventing said upper portion from entering said manhole.

7. A manhole device according to claim 1, wherein said securing means comprises a tapered wedge configured to interfere with an inner surface of said manhole so as to hold said manhole device in position.

8. A manhole device according to claim 1, wherein said single-piece main body comprises a smooth internal surface.

9. A manhole device according to claim 1, wherein said upper portion comprises a visual indicator to improve visibility of said upper portion.

10. A manhole system comprising a manhole and a manhole device, said manhole device comprising:

a single-piece main body comprising an upper portion and a lower portion, said single-piece main body being positioned in said manhole; wherein:

said upper portion protrudes above a surface level, said lower portion comprises a securing means configured to retain said lower portion below said surface level and in said manhole, said single-piece main body provides alignment means to maintain a diameter or dimension of an opening of said manhole, said opening providing access to an underground vault, said single-piece main body being further configured to position and align construction materials around said manhole, said single-piece main body further comprises an outer wall defining an internal space and a top surface, said top surface extending from an edge of said outer wall to cover said internal space, said top surface thereby preventing access into said internal space and providing a barrier so as to prevent access to said manhole during construction, and said single-piece main body comprises at least one slot in said outer wall; and a grating device comprising at least one support bracket for being received into said at least one slot, wherein at least part of said upper portion is removable to provide access for said grating device.

11. A manhole system according to claim 10, wherein at least part of said upper portion is removable from said lower portion to provide access to said manhole from a ground surface.

12. A method of constructing a manhole, comprising the steps of:

obtaining a manhole device having a single-piece main body comprising an upper portion, a lower portion and a securing means, wherein at least part of said upper portion is removable to provide access for a grating device;

positioning said manhole device in said manhole such that said upper portion protrudes above a surface level and said lower portion is retained below said surface level in said manhole;

engaging said securing means with said manhole to secure said manhole device in position;

providing an alignment means to maintain a diameter or dimension of an opening of said manhole, said opening providing access to an underground vault, and said single-piece main body being further configured to position and align construction materials around said manhole by means of said single-piece main body;

preventing access to said manhole during construction by providing a barrier by means of an outer wall defining an internal space and a top surface, said top surface extending from an edge of said outer wall to cover said internal space, said top surface thereby preventing access into said internal space of said single-piece main body; and disposing at least one support bracket of said grating device in at least one slot in said outer wall.

13. A method of constructing a manhole according to claim 12, further comprising the step of:

removing said at least part of said upper portion of said manhole device to provide access to said manhole from a ground surface.

14. A method of constructing a manhole according to claim 12, wherein said step of providing an alignment means comprises:

aligning a plurality of seating rings or bricks around said manhole device.

15. A method of constructing a manhole according to claim 12, further comprising the step of:

providing an indication of required height of a final surface by means of said protruding upper portion.

* * * * *